US009562331B2

(12) United States Patent
Dubois et al.

(10) Patent No.: US 9,562,331 B2
(45) Date of Patent: Feb. 7, 2017

(54) DRAIN CHANNEL FOR A TRAMWAY TRACK

(75) Inventors: Jérôme Dubois, Louviers (FR); Didier Ollivier, Ecardenville sur Eure (FR); Joseph Miquel, Saint Pierre de Bailleul (FR); Cyril Leguy, Civières (FR)

(73) Assignee: ACO, Notre dame de l'Isle (FR)

( * ) Notice: Subject to any disclaimer, the term of this patent is extended or adjusted under 35 U.S.C. 154(b) by 336 days.

(21) Appl. No.: 14/236,383

(22) PCT Filed: Aug. 2, 2012

(86) PCT No.: PCT/FR2012/000326

§ 371 (c)(1),
(2), (4) Date: Mar. 21, 2014

(87) PCT Pub. No.: WO2013/017752

PCT Pub. Date: Feb. 7, 2013

(65) Prior Publication Data

US 2014/0191051 A1 Jul. 10, 2014

(30) Foreign Application Priority Data

Aug. 4, 2011 (FR) ..... 11 02449

(51) Int. Cl.
*E01B 21/02* (2006.01)

(52) U.S. Cl.
CPC ..... *E01B 21/02* (2013.01)

(58) Field of Classification Search
CPC ..... E01B 1/008; E01B 2204/07; E01B 21/02; E03F 3/046
See application file for complete search history.

(56) References Cited

U.S. PATENT DOCUMENTS

| | | | | |
|---|---|---|---|---|
| 3,773,255 | A | 11/1973 | Schoulties et al. | |
| 5,622,208 | A * | 4/1997 | Vinson | F16L 55/11 138/89 |
| 6,173,856 | B1 | 1/2001 | Bierce et al. | |
| 2008/0236691 | A1 * | 10/2008 | Roll | F16L 55/1141 138/92 |

FOREIGN PATENT DOCUMENTS

| | | | |
|---|---|---|---|
| DE | 102005003962 | | 8/2006 |
| DE | 202010008256 | | 11/2010 |
| EP | 2163688 | A2 | 3/2010 |
| EP | 2418322 | | 2/2012 |
| FR | 2 765 599 | * | 3/1916 |

OTHER PUBLICATIONS

International Search Report dated Nov. 12, 2012, corresponding to PCT/FR2012/000326.

Yu Ping, "Discussion about the Development of Modern Trams", Heilongjiang Science and Technology Information, Engineering Science and Technology, School of Transportation, Southwest Jiaotong University, Chengdu, Sichuan Province 610031.

* cited by examiner

*Primary Examiner* — Mark Le
(74) *Attorney, Agent, or Firm* — Young & Thompson

(57) ABSTRACT

A tramway track drainage device includes a drain channel section (5, 6) provided with two ends, at least one end being provided with a wall (14, 16) closing the end. The device further includes an opening (41) created in the wall (14, 16) to form an inspection window for a cable connection (80) with a rail (2) and a plug (60, 70) for closing the opening (41), removable from inside the drain channel section (5, 6).

16 Claims, 5 Drawing Sheets

DRAIN CHANNEL FOR A TRAMWAY TRACK

BACKGROUND OF THE INVENTION

Field of the Invention

The present invention relates to a drainage system for a tramway track or the like. "Or the like" is understood as meaning any railway track which is usefully drained, especially railway tracks that comprise grooved rails.

Description of the Related Art

A platform for a tramway track in an urban area typically consists of a surface in which there are embedded two railway tracks, each formed of two rails. Since the surface of the platform is substantially in alignment with the top end of the rails, mixed traffic (tramway, motor vehicle, bicycle, pedestrian) is possible, the rails forming only a slight irregularity. This platform must be drained, as must the groove of the rails, in order to facilitate the movement of vehicles and people and to avoid degradation due to moisture.

On the other hand, the rails must be connected to electric cables of large cross-section, especially for earthing.

Conventionally, drainage and the electrical connections are carried out at a distance from one another. The electrical connections between the rails and the cables integrated into the platform are accessible with difficulty.

There are known drainage systems composed of drain channel sections, for example made of polymer concrete, which are disposed at certain intervals transversely to the tracks and are covered with grids. From one side of the platform to the other there are found, in succession, a lateral drain channel section, an inter-rail section, an inter-track section, a further inter-rail section and a further lateral section. These sections are embedded in the platform and are connected beneath the rails to form a transverse drain channel.

The connections between drain channel sections are made, for example, with the aid of tubular joining members which are disposed beneath a rail and connect two outlet orifices created in two drain channel sections which are disposed facing one another on each side of the rail. Another joining member can be produced in the form of a spout which is disposed between a drainage hole or slot formed in the hollow profile or groove of the rails and the inside of the drain channel section. Such a system is described in French patent FR 2 765 599. Drainage of the grooves of the rails is obtained by slots formed vertically, corresponding to the drain channels, in the bottom of the grooves. The slots open beneath the groove, above the foot of the rail. The water collected in the groove of the rail is carried away by the drainage slots and then collected by spouts which are disposed at the ends of the drain channel sections and engaged beneath the groove of the rail.

Document DE 20 2010 008 256 describes another spout. The spout is inserted, on assembly, by sliding into a location outside an end face of a drain channel portion. This arrangement is not removable after it has been brought into service. The existing systems do not allow access for inspection or intervention during service. The existing systems are not intended for the passage of cables.

BRIEF SUMMARY OF THE INVENTION

The invention will improve the situation.

A drainage device for a tramway track or the like comprises a drain channel section having two ends, at least one of which is provided with a wall closing said end. The device is remarkable in that it further comprises an opening created in the wall to form an inspection window for a connection of a cable with a rail. The device comprises a plug for closing up said opening, which plug can be removed from inside the drain channel section.

The possibility of withdrawing the plug, after assembly, from inside the drain channel section confers on said section a function of inspection of or access to the rail profile. Such access, especially for maintenance and inspection, makes a connection between the rail and a cable accessible. In the known systems, access to this type of connection is impractical or even impossible. The invention provides a drainage system which can be installed easily and which, after assembly, allows an access path to be made available to the electrical rail-cable connection in a drain channel. Furthermore, a portion of the drain channel can be used to accommodate a portion of the cable of the connection. The Applicant has gone against the prejudice that water and electricity should be kept apart.

The device may further comprise an orifice which is distinct from the opening and is created in the wall for the passage of a cable. In this arrangement, the device on the one hand can receive the cable portion necessary for producing the connection with the rail and on the other hand can effect drainage.

The wall may further comprise a bottom outlet orifice for guiding a flow of liquid to the outside of the drain channel section. The orifice for the passage of a cable being disposed between the opening to form an inspection window and the bottom outlet orifice. The bottom outlet orifice is able to communicate with a tubular element which is in turn connected to another outlet orifice of another drain channel section disposed on the other side of the rail. Such an arrangement allows liquid to flow beneath the tracks, substantially perpendicularly to the direction of the tracks, through the drain channel sections and the tubular components connecting the drain channel sections. Such an arrangement may further permit the passage of cables beneath the rails.

The orifice for the passage of a cable may further comprise a seal establishing tightness with the cable. The seal allows the tightness between the inside and the outside of the drain channel section to be improved in the region of the passage of the cable. The cable may be inserted into the orifice provided for that purpose by elastic deformation of the seal.

The plug may form a core. The core may project from the wall on the side opposite the drain channel section, the core being intended to occupy a space between the opening of the wall and the connection of the cable with the rail. The presence of the core allows the space between the wall and the rail to be kept free of any projections, especially of concrete or elastomer supplied in the liquid state, during construction of the railway track, so as to form an access chamber to said connection from inside the drain channel section.

The end wall of the drain channel section may comprise a first layer of a flexible material and at least one second layer of a rigid material. The flexible material, by elastic deformation, enables good tightness to be achieved between the inside and the outside of the drain channel section and in particular between the bores of the openings and/or orifices and the elements disposed in those openings and/or orifices. The rigid materials contribute to the mechanical strength of the wall. The end wall may comprise a flexible first layer sandwiched between two rigid second layers.

Each of the ends of the drain channel section may be provided with a substantially similar wall. This allows the manufacture of the walls of the drain channel sections to be homogenised. The manufacturing costs and the risks of error on assembly are low. Each opening and/or orifice may be provided with a plug that can be removed on delivery of the components, the operator who carries out the assembly being able to adapt or remove said plugs according to whether the openings and/or orifices are used or not.

The plug may comprise a spout for guiding a flow of liquid coming from the rail towards the inside of the drain channel section. With the plug in the fitted position, the spout provides a drainage function for the rail groove. With the plug removed, from inside the drain channel section, the opening forms an inspection window for the connection of the cables. This arrangement provides a drainage function and a function of checking and maintenance of the electrical connections.

The plug may comprise a flexible material and a deformable structure, the plug comprising a locking surface which is active when the spout is in a guiding state and inactive in a removed state. These features allow the plug to be removed without being damaged. An operator working on the connection from inside the drain channel section is able to replace the plug, with the spout in its active drainage state, at the end of the operation.

A drainage kit for a tramway track comprises at least one first drain channel section and at least one second drain channel section. Each of the sections has two ends, and at least one end is provided with a wall closing said end. An opening is created in the wall to form an inspection window for a connection of a cable with a rail. The kit further comprises at least one removable plug for closing up said opening. The drain channel sections are each to be mounted substantially perpendicularly and facing one another on either side of a rail, so that each opening forms an inspection window for a connection of a cable with the rail. This kit makes it possible to provide both a drainage solution and access to the electrical connections of the rails with the cables. The drain channel sections, in the assembled state, allow a drain channel for a tramway track to be formed. The drain channel sections, in the assembled state, allow a passage for cables to be formed substantially perpendicularly to and beneath the railway tracks. The number and dimensions of the drain channel sections may be adapted depending on the arrangement of the tracks with which the sections are to be associated.

The plug may be in one piece. The plug may comprise a spout for guiding a flow of liquid coming from the rail towards the inside of the first drain channel section. The plug may be fitted, in a removable manner, from inside the first drain channel section, the opening of the first drain channel section having a cross-section that is strictly larger than a tubular portion forming the spout that is to extend towards the outside of the first drain channel section. During operation, the drain channel section performs an additional drainage role for a hollow portion of the rail. The temporary removal of the plug including a spout during maintenance operations opens the inspection window formed by the opening of the wall of the first drain channel section.

The plug may form a core which is to occupy a space between the opening of the wall of the second drain channel section and the connection of the cable with the rail so as to form an access chamber to said connection from inside the second drain channel section. The core allows access to the connection to be kept free of projections or insertions of ductile materials, for example of concrete, elastomer or earth, between the rail and the second drain channel section.

The core may be hollow. This allows an access chamber to the connection of the rail from inside the second drain channel section and by way of the opening to be preserved while the core is left in place during operation, without the need to remove the core during the intervention. A hollow core is more easily deformable and removable through the opening if necessary.

The core may further comprise an additional wall which is substantially parallel to the wall of the second drain channel section after assembly, said additional wall having a cut-out for the passage of a cable from the inside of the second drain channel section to the connection with the rail. Apart from its function of preserving an access chamber, the core may protect a portion of cable disposed between the second drain channel section and the cable-rail connection.

The invention relates also to a drainage system for a tramway track, which drainage system is formed of at least one drain channel section having two ends, at least one end being provided with a wall closing said end. An opening is created in the wall to form an inspection window for a connection of a cable with a rail. The cables used here have high radii of curvature. The cross-section of the cables is also large, typically from 100 to 250 $mm^2$. In a drain channel system for two tracks, that is to say four rails, the number of cables to be disposed within the drainage system can be from 1 to 4. The multiplicity and the poor flexibility of the cables make any loop or U-turn of the cable difficult to envisage. The system permits the passage of the cables while keeping them in a generally straight configuration.

BRIEF DESCRIPTION OF THE DRAWINGS

Other features and advantages of the invention will become apparent from studying the detailed description below and the accompanying drawings, in which.

DETAILED DESCRIPTION OF THE PREFERRED EMBODIMENTS

The accompanying drawings are substantially of a certain nature and may not only serve to complete the invention but also contribute to its definition, where applicable.

The drain channels already marketed by the Applicant are satisfactory in terms of drainage. That is the conventional function of a drain channel. During his research aimed at facilitating the work of his clients, who are railway track layers, the Applicant looked into problems that are unknown to hydraulic engineers. Going against a custom of track layers, the Applicant has designed a system which provides both drainage of water and accessibility to electrical connections.

Figure 1:
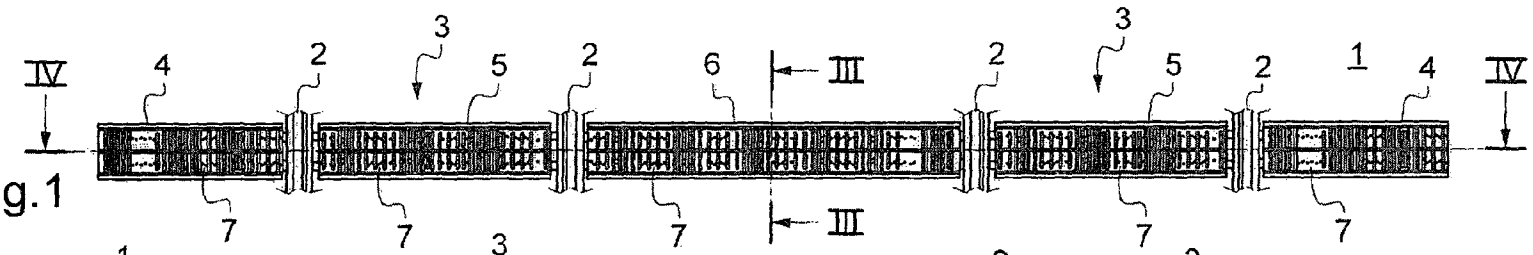
FIG. 1 is a schematic top view of a drainage system.
Figure 2:
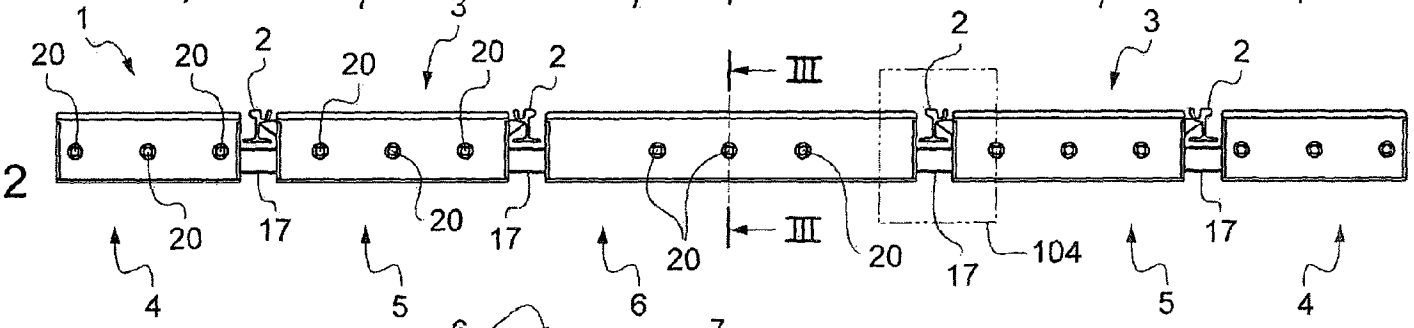
FIG. 2 is a side view of the system of FIG. 1.

FIGS. 1 and 2 show a drainage system of a tramway platform 1 in which there are embedded rails 2 forming two parallel tracks 3. To that end, the system is formed of a drain channel transverse to the tracks 3, comprising two lateral sections 4, two inter-rail sections 5 and a central inter-track section 6. The sections 4, 5, 6 are disposed in trenches of suitable cross-section and are here connected together by tubular elements 17 which are disposed perpendicularly to and beneath the rails 2 and are not visible in FIG. 1.

Figure 3:
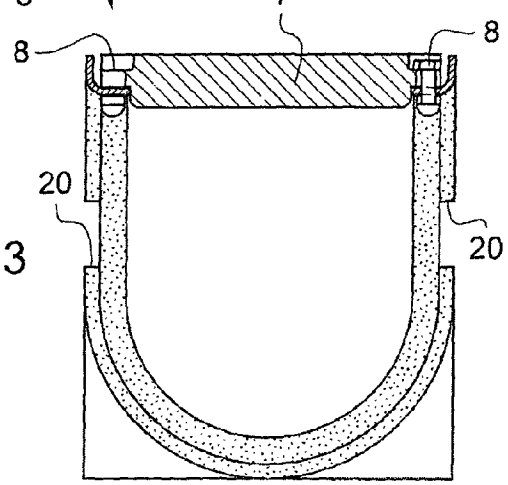
FIG. 3 is a partial view in vertical section along line III-III of FIGS. 1 and 2.

A drain channel section 4, 5, 6 is formed substantially of a U-shaped profile which is open at the top and is made, for example, of polymer concrete. A straight section of such a section is shown in FIG. 3. A grid 7 is fixed by means of screws 8 to the top of the profile in order to close it, at the level of the running surface of the rails 2. Each drain channel section 4, 5, 6 is also closed at each of its longitudinal ends by a wall 14, 16 which is inserted or adhesively bonded, see FIGS. 4, 5, 7 and 8.

Figure 4:
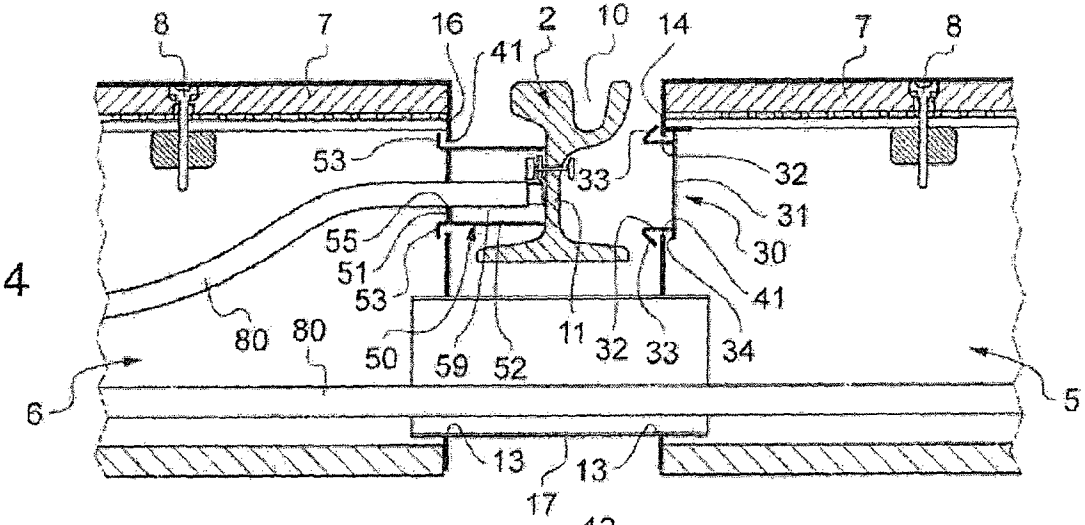
FIG. 4 is an enlarged view of detail 104 of FIG. 2 in section along line IV-IV of FIG. 1, FIGS. 5A to 5C are views similar to FIG. 4 of another embodiment, in different states.

The rails 2 have a guide profile or groove 10 which is open to the top and is offset laterally from a stem 11 (on the right in FIGS. 4 and 5). Drainage slots 12 are formed in the bottom of the groove 10 and open, at the bottom, on the side of the stem 11 where the guide groove 10 is offset, generally on the inner side of the track 3. The stem 11 is supported by a foot which is substantially perpendicular to the stem and horizontal.

The rails 2 are supported by concrete blocks (not shown) by way of their foot. The system comprises a tubular element 17, for example a polyethylene sleeve, which connects two adjacent sections 5, 6 by passing beneath the rail 2. The tubular element 17 is engaged in bottom outlet orifices 13 created in each of the end walls 14, 16 of the two drain channel sections 5, 6 disposed on either side of the rail 2.

Figure 7:
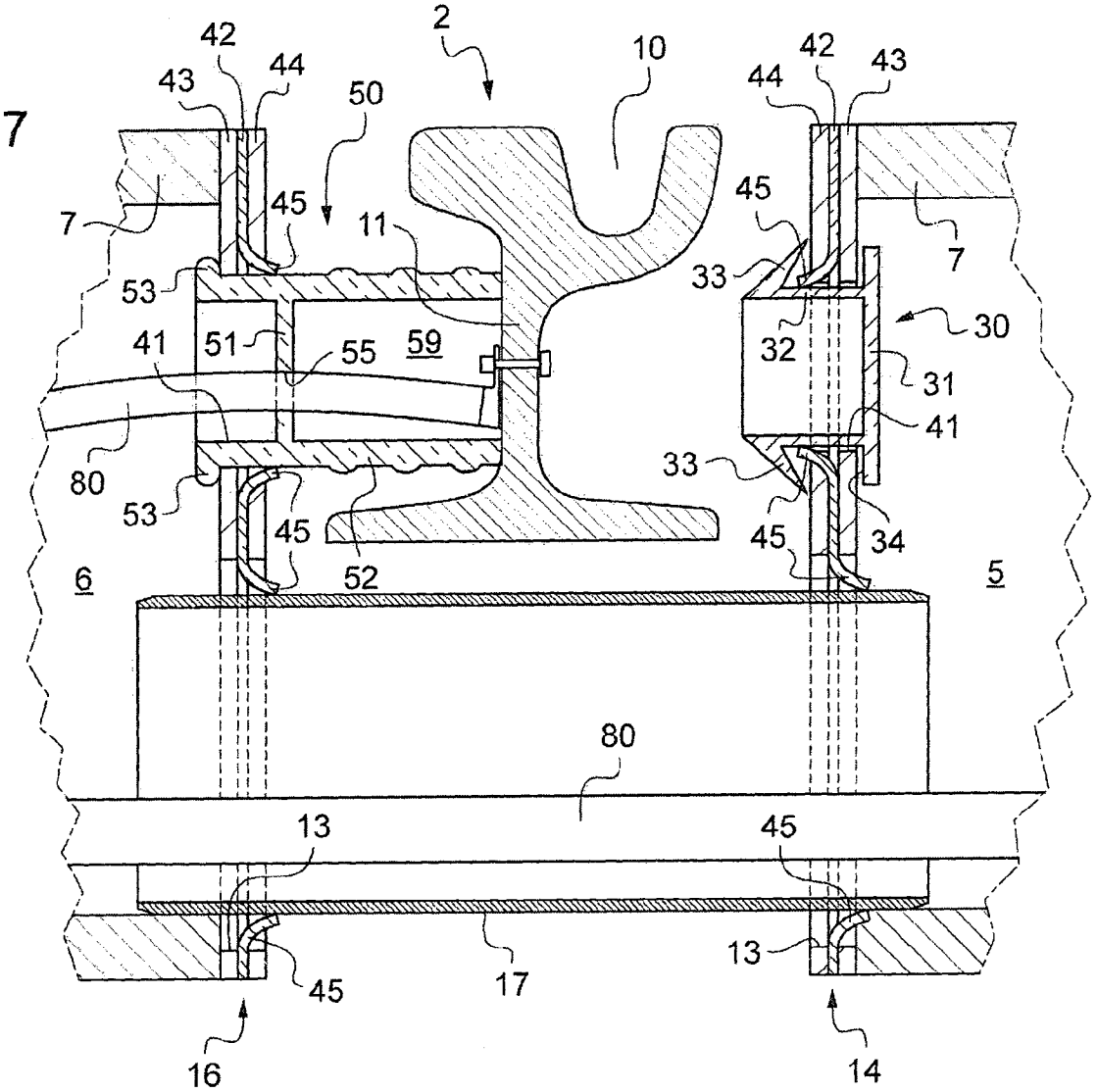
FIG. 7 is a detail view of the embodiment of FIG. 4.
Figure 8:
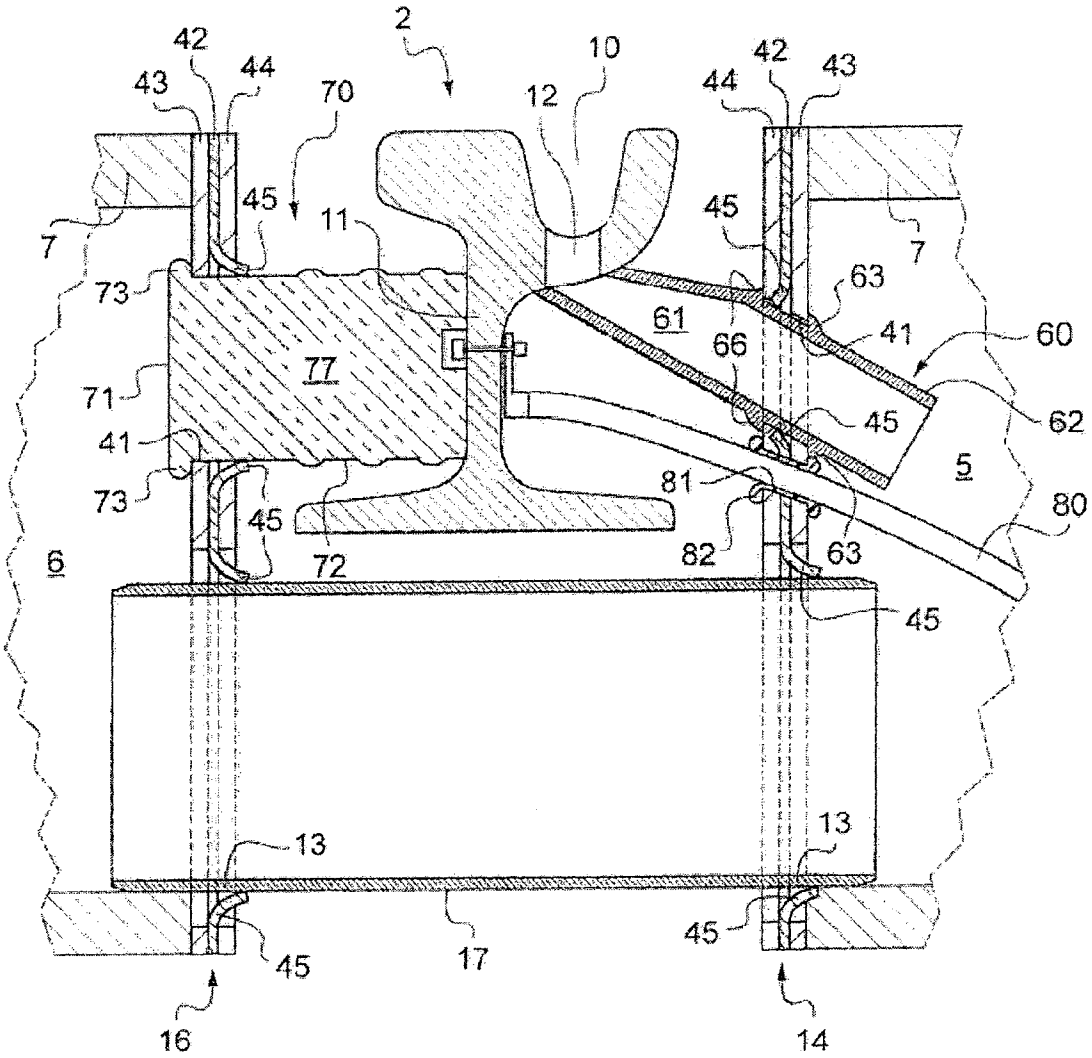
FIG. 8 is a detail view of the embodiment of FIGS. 5A to 5C.

The drainage water collected in the drain channel sections 4, 5, 6 may be carried away perpendicularly to the tracks 3 by the drain channel and then parallel to the tracks 3 by a suitable collector (not shown) or by way of discharge conduits disposed at a lower level than that of the bottom of the drain channel sections 4, 5, 6. As can be seen in FIGS. 4 and 7, the drain channel sections 4, 5, 6 may further permit the passage of a cable 80 beneath a rail 2 to which is it not connected. In this case, the tubular element 17 and the bottom outlet orifices 13 receive a portion of the cable 80.

As can be seen in FIGS. 2 and 3, the drain channel sections 4, 5, 6 are, in the example described here, provided on their longitudinal walls with pre-marks 20. The pre-marks 20 are blind holes which facilitate the drilling of the longitudinal walls by an operator, on assembly, if required. Such holes may be necessary for the recovery of infiltration water, in particular when the covering of the surface of the platform 1 is porous, for example turfed. Perforated drainage pipes of the agricultural type (not shown) may be disposed substantially parallel to the tracks 3, between each drain channel, and open into drain channel sections 4, 5, 6 by way of holes formed starting from the pre-marks 20.

As is shown in FIGS. 4 and 7, the stem 11 of the rail 2 is drilled in order to receive a screw for fixing, with the aid of a nut and a bracket, the end of a cable 80 for earthing. The first drain channel section 5 comprises an opening 41 created in the wall 14 closing one end of the drain channel section 5 (on the right in FIGS. 4 and 7). In the assembled state, the opening 41 is situated opposite the connection between the cable 80 and the rail 2. The opening 41 forms an inspection window for the connection of the cable 80 with the rail 2.

In one embodiment, which is shown in the right-hand portion of FIGS. 4 and 7, in the operating state, the opening 41 is closed up by a removable plug 30. The plug 30 is here in one piece. In a variant, the plug 30 comprises a plurality of assembled parts. The plug 30 is solid. The plug 30 comprises a wall 31 having a shape substantially similar to the shape of the opening 41 and having a surface area strictly greater than the cross-section of the opening 41. The plug 30 comprises a tubular wall 32 which extends substantially perpendicularly to the wall 31 and is aligned, at a distance, with edges of the wall 31. The tubular wall 32 has a length substantially equal to the thickness of the end wall 14. The shape of the tubular wall 32 is here substantially similar to the shape of the opening 41 of the first drain channel section 5. The outside dimensions of the tubular wall 32 are strictly smaller than the dimensions of the opening 41 so that the tubular wall 32 can be inserted through the opening 41. The surface of the wall 31 situated between the tubular wall 32 and the edges forms a periphery 34. Lugs 33 extend in a diametrally outer direction from the end of the tubular wall 32 opposite the wall 31.

In the assembled state, the tubular wall 32 of the plug 30 is disposed in the opening 41. The lugs 33 rest on an outer surface of the wall 14 on the periphery of the opening 41. The periphery 34 of the plug 30 rests on an inner surface of the wall 14 on the periphery of the opening 41. The lugs 33 and the periphery 34 of the plug 30 partially enclose the periphery of the opening 41. The lugs 33 and the periphery 34 form stop surfaces for the positioning of the plug 30 in the opening 41. The plug 30 is held at least partially in the opening 41. The plug 30 is of a structure and a material which are deformable. The deformability of the plug 30 allows the plug 30 to be removed from inside the first drain channel section 5. In a variant, the deformability of the plug 30 allows the outside dimensions of the tubular wall 32 to be identical to or even slightly greater than the dimensions of the opening 41. Removal of the plug 30 during maintenance operations confers on the opening 41 its function of an inspection window for the connection of the cable 80 with the rail 2. The plug 30 is fitted in a removable manner from inside the first drain channel section 5.

In one embodiment, which is shown in the left-hand portion of FIGS. 4 and 7, the second drain channel section 6 comprises a plug forming a core 50. The core 50 is here in one piece. In a variant, the core 50 comprises a plurality of assembled parts. The core 50 comprises a tubular portion 52. The shape of the tubular portion 52 is here substantially similar to the shape of the opening 41 of the second drain channel section 6. The outside dimensions of the cross-section of the tubular portion 52 are strictly smaller than the dimensions of the opening 41 so that the tubular portion 52 can be inserted through the opening 41. The tubular portion 52 has a length greater than the distance between the surface of the stem 11 of the rail 2 and an inner surface of the end wall 16 of the second drain channel section 6, in the assembled state. The tubular portion 52 comprises annular ribs on its outer surface. The annular ribs contribute to the mechanical strength of the core 50.

The core 50 comprises lugs 53 which extend in a diametrally outer direction from one end of the tubular portion 52. The core 50 comprises, in the example described here, an additional wall 51. The additional wall 51 is disposed substantially perpendicular to the tubular portion 52 and in the bore of said tubular portion 52. The additional wall 51 delimits two distinct portions inside the tubular portion 52. Here, the additional wall 51 is placed at a small distance from the lugs 53. In a variant, the additional wall 51 can be aligned with the lugs 53 or alternatively can be disposed on the side of the tubular portion 52 remote from the lugs 53. The additional wall 51 comprises a cutout 55 adapted for the passage of a cable 80.

In the assembled state, the lugs 53 are in abutment on an inner surface of the wall 16 on the periphery of the opening 41. The lugs 53 form stop surfaces for the positioning of the core 50 in the opening 41. The tubular portion 52 extends for the most part outside the second drain channel section 6 from the end wall 16 in the direction of the stem 11 of the rail 2. The end of the tubular portion 52 situated opposite the lugs 53 and the second drain channel section 6 is in contact with the stem 11 of the rail 2. Said end of the tubular portion 52 surrounds the connection between the cable 8 and the stem 11 of the rail 2. The additional wall 51 is here substantially a continuation of the end wall 16 of the second drain channel section 6 inside the tubular portion 52. The tubular portion 52 is hollow.

The tubular portion 52, the additional wall 51 and the outer surface of the stem 11 delimit a chamber 59. The cable 80 connected to the stem 11 of the rail 2 is disposed inside the second drain channel section 6 as far as the connection with the rail 2, passing through the cutout 55 and the chamber 59. The plug 50 is of a structure and a material which are deformable. The deformability of the plug 50 allows the core 50 to be removed from inside the second drain channel section 6. In a variant, the deformability of the plug 50 allows the outside dimensions of the tubular portion 52 to be identical to or even slightly greater than the dimensions of the opening 41. Removal of the core 50 during maintenance operations confers on the opening 41 its function as an inspection window for the connection of the cable 80 with the rail 2. In the case of temporary removal of the core 50 from the opening 41, the core 50 remains threaded round the cable 80 in the second drain channel section 6, which prevents the core 50 from being lost. The core 50 is fitted in a removable manner from inside the second drain channel section 6.

During operation, after assembly, the core 50 occupies a space between the opening 41 of the end wall 16 of the second drain channel section 6 and the connection of the cable 80 with the rail 2. The space so occupied remains free of any filling materials introduced around the rail 2 during manufacture of the tracks 3. On removal of the core 50, during maintenance, the space becomes an access chamber to the connection from inside the second drain channel section 6. In the example described here, the core 50 further protects the portion of the cable 80 that is disposed between the second drain channel section 6 and the cable-rail connection.

Figure 5A:
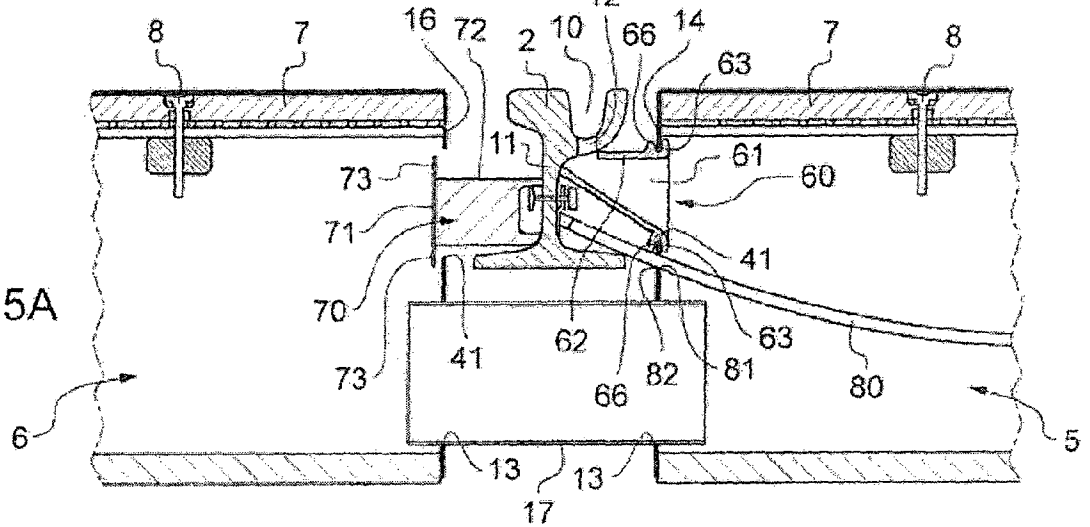
Figure 5B:
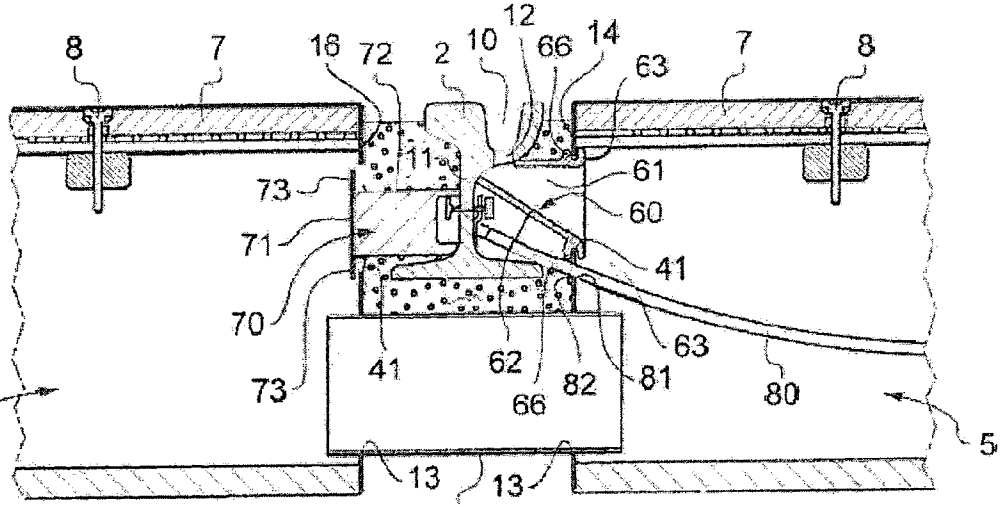
Figure 5C:
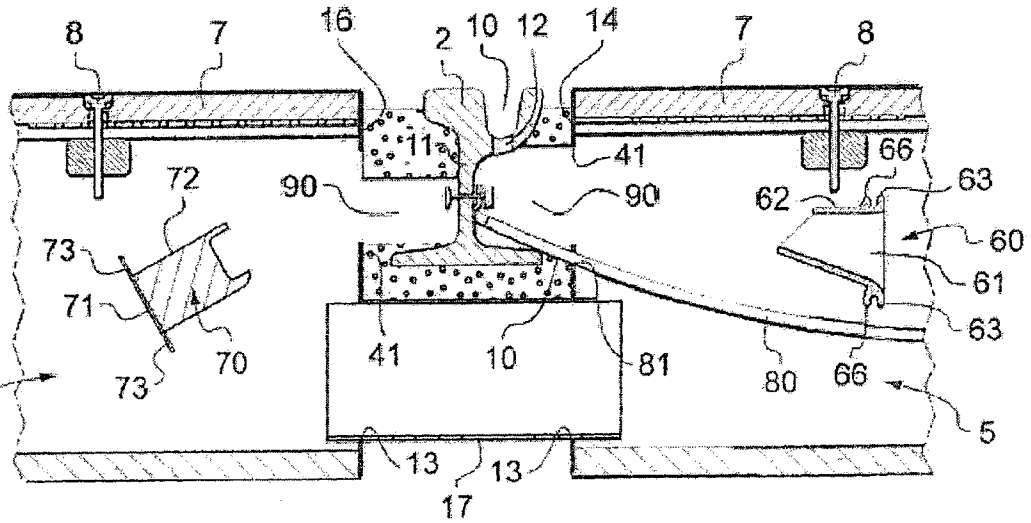

In an embodiment shown in the left-hand portion of FIG. 5A on assembly and 5B in the operating state, the opening 41 is closed up by a core 70 that is substantially similar to the core 50 of the embodiment of FIG. 4 (the reference numerals have been incremented by 20). Here, the core 70 is solid. The chamber is filled with the material constituting the core 70. The additional wall 71 is aligned with the lugs 73. Since the cable 80 is disposed on the other side of the rail 2, a cable passage in the core 70 is not necessary. The end of the core 70 that is to be in contact with the stem 11 of the rail 2 is arranged to cover the connection of the cable 80 and the rail 11. During maintenance operations, which are shown in FIG. 5C, the core 70 can be removed through the inside of the second drain channel section 6. Removal of the core 70 frees the space between the connection and the opening 41. The space becomes an access chamber 90 to the connection from inside the second drain channel section 6. The opening 41 becomes an inspection window.

In an embodiment shown in the right-hand portion of FIG. 5A on assembly and 5B in the operating state, the opening 41 is closed up by a plug 60 comprising a spout 61. The plug 60 is here in one piece. In a variant, the plug 60 comprises a plurality of assembled parts. The plug 60 comprises a tubular portion 62. The shape of the outer cross-section of the tubular portion 62 is here substantially similar to the shape of the opening 41 of the first drain channel section 5. The outside dimensions of the cross-section of the tubular portion 62 are strictly smaller than the dimensions of the opening 41 so that the tubular portion 62 can be inserted through the opening 41. The tubular portion 62 has a length that is greater than the distance between the bottom opening of the drainage slot 12 of the rail 2 and an inner surface of the end wall 14 of the first drain channel section 5, in the assembled state.

The plug 60 comprises lugs 63 which extend in a diametrally outer direction from one end of the tubular portion 62. The plug 60 comprises lugs 66 which extend in a diametrally outer direction from the outer surface of the tubular portion 62. The lugs 66 extend substantially perpendicularly to the lugs 63. The lugs 63 and 66 are spaced from one another by a distance that is substantially equal to the thickness of the end wall 14 around the opening 41. The lugs 63 and 66 and the end of the tubular portion 62 supporting said lugs 63 and 66 have a "C"-shaped cross-sectional profile according to the plane of FIGS. 5 and 8.

The tubular portion 62 comprises an inner surface. The inner surface defines the spout 61. The spout 61 forms a channel or hole passing over the length of the tubular portion 62. The spout 61 opens on either side of the plug 60.

In the assembled state, the outer covering of the tubular portion 62 may further perform a function substantially similar to that of the cores 50, 70 described hereinbefore. The tubular portion 62 is arranged to allow the plug 60 to be removed from inside the drain channel section 5.

In the assembled state, part of the tubular portion 62 surrounding the spout 61 is disposed through the opening 41. The lugs 63 rest on an inner surface of the wall 14 on the periphery of the opening 41. The lugs 66 rest on an outer surface of the wall 14 on the periphery of the opening 41. The "C"-shaped profile partially encloses the periphery of the opening 41. The totality of the surfaces of the plug 60 that are in contact with the periphery and the bore of the opening 41 form a locking surface. The tubular portion 62 is held at least partially in the opening 41. The plug 60 is of a structure and a material that are deformable. The deformability of the plug 60 allows the plug 60 to be removed from inside the first drain channel section 5. In a variant, the deformability of the plug 60 allows the outside dimensions of the tubular portion 62 to be identical to or even slightly greater than the dimensions of the opening 41. Removal of the plug 60 during maintenance operations, shown in FIG. 5C, confers on the opening 41 its function as an inspection window for the connection of the cable 80 with the rail 2.

The tubular portion 62 extends for the most part outside the first drain channel section 5 from the end wall 14 in the direction of the drainage slot 12 of the rail 2. The end of the tubular portion 62 that is remote from the lugs 63 and the first drain channel section 5 is here in contact with the periphery of the drainage slot 12 of the rail 2. The end of the tubular portion 62 surrounds the bottom end of the drainage slot 12 of the rail 2. The spout 61 of the plug 60 permits a flow of liquid coming from a drainage slot 12 of a guide groove 10 of the rail 2 towards the inside of the first drain channel section 5. The spout 61 has a guiding state, in the fitted state of the plug 60 in the opening 41, in which the locking surface is active, see FIGS. 5A and 5B. The plug 60 has a dismantled state, removed from the opening 41, in which the locking surface is inactive, see FIG. 5C. When the locking surface is inactive, the opening 41 is an inspection window. The space left free by the removal of the tubular portion 62 is an access chamber 90 to the connection.

In the example described here, the end wall 14 of the first drain channel section 5 further comprises an orifice 81 which is distinct from the opening 41 and is created in the end wall 14 for the passage of a cable 80. The orifice 81 for the passage of a cable 80 is here disposed in the end wall 14 between the opening 41 and the bottom outlet orifice 13. The orifice 81 for the passage of the cable 80 further carries an elastomer-based seal 82 (not shown in FIG. 5) which is disposed in the bore of the orifice 81. The seal 82 permits good tightness between the outer surface of the section of cable 80 disposed in the orifice 81 and the bore of said orifice 81. The cable 80 extends from the inside of the first drain channel section 5 through the seal 82 and the orifice 81 for the passage of the cable to the connection with the stem 11 of the rail 2.

FIG. 5A shows an embodiment of the drainage system in the course of assembly, that is to say after the drain channel sections 5, 6 have been positioned. FIG. 5B shows a step following FIG. 5A, after filling to fill in the empty spaces around the rail 2, for example when the tracks 3 are in service. Filling is carried out by means of filling materials, for example slivers of foam covered with a seal cast at the surface. Other filling methods may be used. FIG. 5C shows a step preceding or following FIG. 5B, for example in the course of maintenance. The plugs 60, 70 have been removed from their locations from inside the drain channel sections 5, 6. The space left free by the plugs 60, 70 reveals the access chambers 90 within the filling material. The openings 41 are then inspection windows.

Figure 6:
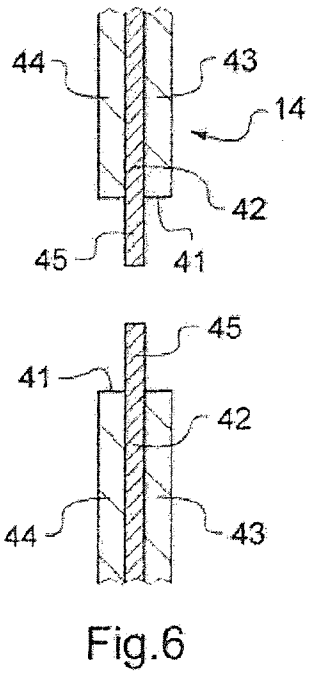
FIG. 6 is a detail view in section of an end wall.

As is shown in FIG. 6, an end wall 14, 16 here comprises a first layer 42 of a flexible material, for example an elastomer, and two second layers 43, 44 of a rigid material, for example stainless steel. The first layer 42 of flexible material is here sandwiched between the two second layers 43, 44 of a rigid material. This sandwich arrangement allows a large opening cross-section to be created in the rigid sheets and a small opening cross-section to be created in the flexible sheet when the openings 41 and/or orifices 13, 80 created in the walls 14, 16 are drilled. In other words, the opening 41 comprises a reduction in cross-section, located in the thickness of the end wall 14, due to the presence of the first layer 42. The additional material of the first layer 42, projecting towards the inside of the opening 41, forms a substantially annular lip 45. Owing to its elastic deformability, the lip 45 of flexible material improves the tightness between the bore of the opening 41 and an outer surface of a section of the plug 30, 50, 60, 70 disposed in the opening 41, in the assembled state. In a variant, an annular lip 45 in the orifice 80 replaces the seal 82 of FIG. 8. On insertion of said sections, the annular lip 45 bends in the insertion direction. The lip 45 is deformed and forms a seal for the opening 41 while being integral with the first layer 42. The bore in the second layers 43, 44 is rigid. The peripheries of the opening 41 are rigid. The stop surfaces of the plugs 30, 50, 60, 70 are maintained correctly against the rigid peripheries.

In a variant, the assembled system may be a combination of the right-hand and left-hand portions of each of the embodiments of FIGS. 4, 5, 7 and 8. In particular, the cable 80 may be disposed substantially inside the first drain channel section 5 or substantially inside the second drain channel section 6 or alternatively may pass through the stem 11 of the rail 2 and extend from the inside of the first drain channel section 5 to the inside of the second drain channel section 6.

In a variant, each of the ends of the drain channel sections 4, 5, 6 may be provided with substantially similar end walls 14, 16. In this variant, the openings 41, the orifices 81 and/or the bottom outlet orifices 13 may be closed up by various removable and compatible plugs 30, 50, 60, 70. For example, the drain channel sections 4, 5, 6 may be provided with identical openings 41. The drain channel sections 4, 5, 6 may be sold with or without plugs 30 closing up the openings 41 or alternatively with the plugs 30, 50, 60, 70 supplied separately. The drain channel sections 4, 5, 6 may be sold and supplied as elements of a kit, the kit further comprising one or more types of plugs 30, 50, 60, 70. An operator can remove the plug 30 in order to free the openings 41 that are necessary according to the desired use and can fit a plug 30, 50, 60, 70 therein before, during or after the assembly of the drain channel sections 4, 5, 6 in their final locations.

After assembly of the drain channel sections 4, 5, 6 in their final locations in correspondence with the tracks, the whole forms a drainage system, or drain channel, for tramway tracks.

Although the drain channel in the examples described here is intended for tramway tracks, the invention can be adapted to any railway track the top end of which is substantially in alignment with the surrounding ground and access to which from the side during operation is of interest. This system may be adapted especially to railway tracks of transport or handling means, such as those present in some industrial zones, ports, etc.

The common accomplishment of drainage of the rails and the electrical connections allows common components and operations to be used during construction of tramway tracks. Dealing with these two problems together allows savings to be made.

The invention is not limited to the process and apparatus examples described above solely by way of example but encompasses all variants which the person skilled in the art may envisage within the scope of the following claims.

The invention claimed is:

1. A drainage device for a tramway track, the drainage device comprising:

a drain channel section having two ends, at least one end being provided with a wall closing said end;

an opening defined in the wall and configured to form an inspection window for a connection of a cable with a rail; and a plug configured to close the opening, the plug being configured to be removed from inside the drain channel section, wherein the plug further forms a core, the core projecting from the wall on the side opposite the drain channel section, the core occupying a space between the opening of the wall and the connection of the cable with the rail.

2. The device according to claim 1, further comprising an orifice which is distinct from the opening and is defined in the wall passage of the cable, wherein the wall comprises a bottom outlet orifice to guide a flow of liquid to the outside of the drain channel section, the orifice being disposed between the opening and the bottom outlet orifice.

3. The device according to claim 2, further comprising a seal configured to establish tightness with the cable.

4. The device according to claim 1, wherein the wall comprises a first layer of a flexible material and at least one second layer of a rigid material.

5. The device according to claim 1, wherein each of the ends of the drain channel section is provided with a substantially similar wall.

6. The device according to claim 1, wherein the plug further comprises a spout for the flow of liquid coming from the rail towards the inside of the drain channel.

7. The device according to claim 6, wherein the plug comprises a flexible material and a deformable structure, the plug comprising a locking surface which is active when the spout is in a guiding state.

8. A drainage kit for a tramway track, the drainage kit comprising:

at least one first section and at least one second section, each of the sections having two ends, at least one end being provided with a wall closing said end, an opening defined in the wall and configured to form an inspection window for a connection of a cable with a rail, and a removable plug configured to close the opening, the sections each being configured to be mounted substantially perpendicularly and facing one another on either side of the rail so that each opening forms the inspection window for the connection of the cable with the rail, wherein the removable plug further forms a core, the core projecting from the wall on the side opposite the respective section, the core occupying a space between the opening of the wall and the connection of the cable with the rail.

9. The drainage kit according to claim 8, wherein the plug comprises a spout configured to guide a flow of liquid coming from the rail towards the inside of the first drain channel section, the plug being configured to be fitted in a removable manner from inside the first drain channel section, the opening of the first drain channel section having a cross-section that is strictly larger than a tubular portion of the plug forming the spout that is to extend towards the outside of the first drain channel section.

10. The drainage kit according to claim 8, wherein the plug forms the core which is configured to occupy the space between the opening of the wall of the second drain channel section and the connection of the cable with the rail to form an access chamber to said connection from inside the second drain channel section.

11. The drainage kit according to claim 10, wherein the core is hollow.

12. The drainage kit according to claim 11, wherein the core comprises an additional wall which is substantially parallel to the wall of the second drain channel section after assembly, said additional wall having a cut-out for the passage of the cable from the inside of the second drain channel section to the connection with the rail.

13. The device according to claim 2, wherein the wall comprises a first layer of a flexible material and at least one second layer of a rigid material.

14. The device according to claim 2, wherein each of the ends of the drain channel section is provided with a substantially similar wall.

15. The device according to claim 2, wherein the plug further comprises a spout for the flow of liquid coming from the rail towards the inside of the drain channel.

16. The drainage kit according to claim 9, wherein the plug forms the core which is configured to occupy the space between the opening of the wall of the second drain channel section and the connection of the cable with the rail to form an access chamber to said connection from inside the second drain channel section.

* * * * *